US008122683B1

(12) United States Patent
Schwalenberg

(10) Patent No.: US 8,122,683 B1
(45) Date of Patent: Feb. 28, 2012

(54) SUPPORT PANEL FOR THIN BRICK

(76) Inventor: Chester Schwalenberg, Newington, CT (US)

( * ) Notice: Subject to any disclaimer, the term of this patent is extended or adjusted under 35 U.S.C. 154(b) by 0 days.

(21) Appl. No.: 12/823,454

(22) Filed: Jun. 25, 2010

Related U.S. Application Data

(62) Division of application No. 11/117,135, filed on Apr. 28, 2005, now Pat. No. 7,743,569.

(60) Provisional application No. 60/567,059, filed on Apr. 30, 2004.

(51) Int. Cl.
*E04G 21/14* (2006.01)
*E04F 13/14* (2006.01)

(52) U.S. Cl. ..... 52/747.1; 52/747.12; 52/385; 52/386; 52/389

(58) Field of Classification Search ..... 52/364–367, 52/288.1, 389, 509–510, 506.01, 506.03, 52/506.04, 506.05, 506.06, 506.08, 478, 52/323, 550, 222, 318–321, 513, 742.13, 52/742.14, 742.16, 745.19, 747.1, 747.11, 52/747.12, 384–387
See application file for complete search history.

(56) References Cited

U.S. PATENT DOCUMENTS 3,005,293 A * 10/1961 Hunter ..... 52/385
6,408,585 B1 * 6/2002 Tajima ..... 52/506.06
6,802,165 B1 * 10/2004 Passeno ..... 52/387
2004/0050003 A1 * 3/2004 Passeno ..... 52/384
* cited by examiner

*Primary Examiner* — Jeanette E. Chapman
(74) *Attorney, Agent, or Firm* — Steven M. Hoffberg; Ostrolenk Faber LLP

(57) ABSTRACT

A support panel for thin brick, comprising a metal sheet, an array of groove retaining tabs having first tab edges, said first tab edges protruding from said sheet having at an upward angle of less than about 45 degrees, for a distance of less than about one quarter inch, and an array of mortar lock tabs having second tab edges, said second tab edges protruding from said sheet at a downward angle of greater than about 45 degrees, said array of mortar lock tabs being offset vertically from said array of groove retaining tabs, wherein, said array of groove retaining tabs are adapted to engage shallow dove-tail grooves formed in the rear of thin bricks, and said mortar lock tabs are adapted, when embedded within a cured mortar matrix, to exert, in response to a tensile force away from said metal sheet, a force along a vertical axis, on the brick, in an opposite direction to a force applied to the brick along a vertical axis by said groove retaining tab, to thereby retain the brick against the panel.

21 Claims, 7 Drawing Sheets

Prior Art Thin Set Interior Finish Over Wallboard

Prior Art Thick Set Method Over Masonry

Prior Art Thick Set Method Over Steel Stud Framing

Prior Art Thin Brick Panel

Prior Art Steel Support for Thin Brick

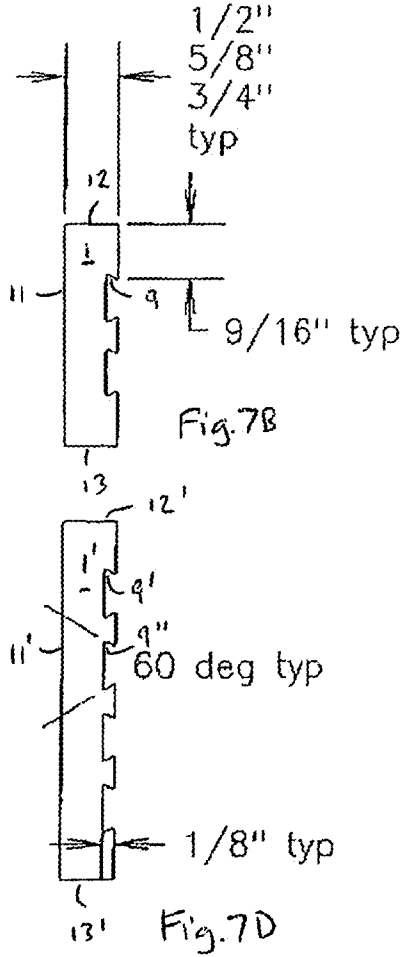
1/2"
5/8"
3/4"
typ
9/16" typ
12
1
9
11
13
Fig.7B
12'
1'
9'
9"
60 deg typ
11'
1/8" typ
13'
Fig.7D
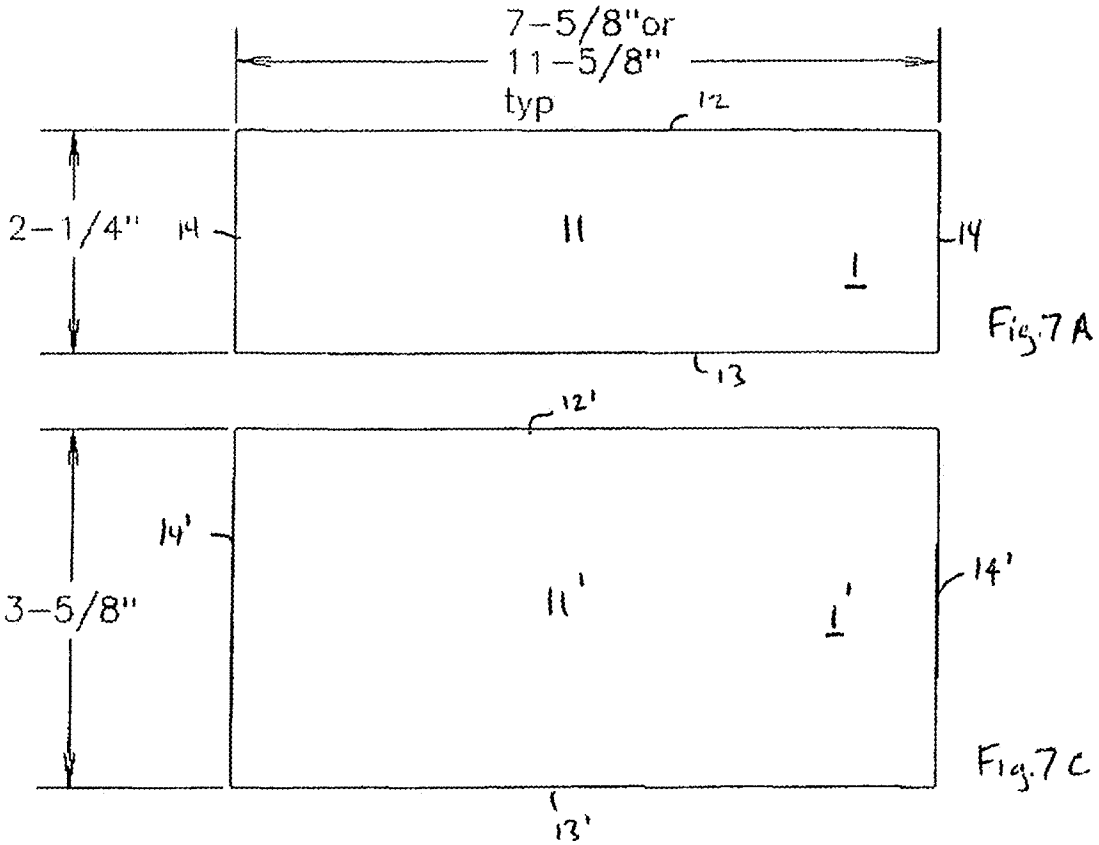
7-5/8" or
11-5/8"
typ
14
1
12
11
13
Fig.7A
2-1/4"
14'
1'
12'
11'
13'
Fig.7C
3-5/8"

SUPPORT PANEL FOR THIN BRICK

FIELD OF THE INVENTION

The present invention relates to the field of support panels, and more particularly to a support panel adapted for supporting thin brick on a fascia, suitable for exterior architectural application

BACKGROUND OF THE INVENTION

Thin primarily brick functions as an architectural wall covering that has the low maintenance benefits of conventional brick masonry. Secondarily, thin brick will provide some protection to the material over which it is applied.

Thin brick, as well as architectural mounting systems therefore, are well known. Typically, a mounting panel, which may be a painted or galvanized steel sheet, is affixed to a vertical wall of a building, for example, over an environmental barrier and exterior grade plywood. The known mounting panels have ledges for the supporting the bottom of the thin brick. In this case, bricks are retained in place with an adhesive, designed to hold the thin brick until mortar is applied and sets.

The Brick Institute of America has issued Technical Notes 28C, Thin Brick Veneer—Introduction [January 1986] (Reissued January 2001), available at www.bia.org/BIA/technotes/t28c.htm. Thin brick are generically known as thin fired clay units, which are employed as interior or exterior wall coverings. Thin brick veneer is used in commercial, residential and do-it-yourself markets. Thin brick units are typically formed from shale and/or clay, and are kiln-fired. These thin brick units are much like facing brick (ASTM C 216), except they are approximately ½ to 1 in. (12 to 25 mm) thick. The face sizes are normally the same as conventional brick and therefore, when in place, give the appearance of a conventional brick masonry wall. ASTM C 1088 Thin Veneer Brick Units made from Clay or Shale covers two grades for exposure conditions to weather which are defined as Exterior and Interior. The three types of thin veneer brick are based on appearance and are defined as TBS, TBX and TBA. Minimum compressive strengths are not required in C 1088 as there is no way to test thin brick in compression.

In the early 1950's, the Structural Clay Products Research Foundation (now the Brick Institute of America) began the development of "SCR Re-Nu-Veneer", a ¾ in. (19 mm) thick fired clay unit which had Norman size nominal face dimensions (2⅔ in. by 12 in. [68 mm by 305 mm]). In addition to developing the thin units, the Foundation developed special clips to attach the units to an existing wall, mortar for grouting the joints and a power-driven grouting gun. Today, thin brick are being installed using a variety of procedures. In Japan and in the United States, thin brick have been placed into forms and cast integrally with concrete, thus providing a very attractive architectural precast concrete panel. Another procedure involves bonding thin brick to a 16 in. by 48 in. (406 mm by 1220 mm) substrate, resulting in small, lightweight, easily installed modular panels. Ceramic tile installation techniques are often used to install the brick units, either at the jobsite or on prefabricated panels, and homeowners are renovating with do-it-yourself thin brick products.

Thin brick are available in various sizes, colors and textures. The most commonly found face size is standard modular with nominal dimensions of 2⅔ in. by 8 in. (68 mm by 203 mm). The actual face dimensions vary slightly among manufacturers, but are typically ⅜ in. to ½ in. (10 mm to 13 mm) less than the nominal dimensions. The economy size unit is 50% longer and higher, with the same aspect ratio, with a face size of 4 in. by 12 in. (102 mm by 305 mm). Other sizes, such as Norwegian, 3-in. (76 mm), non-modular, oversize, etc., may be available.

There are several methods of thin brick installation. Adhered veneer relies on a bonding agent between the thin brick units and the backup substrate. Adhered veneer construction may be classified as either thin bed set or thick bed set. The thin bed set procedure typically utilizes an epoxy or organic adhesive, and is normally used on interior surfaces only. For areas subject to dampness, only clear and dry masonry surfaces or concrete surfaces should be used for backup. For dry locations, the backing material (substrate) may be wood, wallboard, masonry, etc. A cross-section depicting a wood frame wall upon which thin brick veneer (thin set procedure) is installed is shown in FIG. 1.

The thick bed set procedure is often used on interior and exterior surfaces. The backing material may be masonry, concrete, steel or wood stud framing. The thick bed setting procedure over concrete masonry is illustrated in FIG. 2. The wire lath shown in FIG. 2 may be eliminated if the masonry wall is heavily scarified (sand-blasted). (Williams, Griffith, Jr., "New Bricklike Tile Veneer", *Building Standards*, July-August, 1982). For applications over steel studs, procedures are similar to those used for concrete or masonry backup; however, wallboard and building felt must be installed over the studs before the lath and mortar bed are placed. Thick bed setting of thin brick over steel studs is shown in FIG. 3.

Prefabrication, utilizing thin brick veneer units, has been accomplished using the "casting" method. This process involves the combination of thin brick, grout and/or concrete cast into a prefabricated panel (similar to architectural precast concrete). This process requires the use of forms, a method of placing the units, and a system for grouting. The usual practice is to place the units face down into a form (or waffle mold), and place a very fluid grout over the back surface of the units. The grout flows into the space between the units, thus forming the appearance of mortar joints. Concrete and reinforcement are placed over the grout to provide structural support.

Modular panels are produced by several different companies and each system differs slightly. Basically, thin brick units are adhered to modular panels in the factory, or at the jobsite. The modular panels have dimensions of approximately 16 in. by 48 in. (406 mm by 1220 mm), as shown in FIG. 4. The backing materials to which the brick units are adhered may consist of polystyrene, polyurethane, cementitious board, asphalt-impregnated fiber board, plywood, aluminum, or a combination of these materials, depending on the manufacturer.

The panels weigh approximately 35 lb (16 Kg), which is light enough for one person to handle easily. Installation techniques vary only slightly among the different manufacturers. The head and bed joints between the thin brick units may be grouted after the panels are secured to the supporting wall.

Key-Lok Thin Brick Systems, Inc. produces a steel panel adapted for supporting thin brick. See, U.S. Pat. No. 6,802,165 (US 2003/0213212, Nov. 20, 2003), expressly incorporated herein by reference. See also, www.key-lok.com. The Key-Lok Thin Brick Siding is a mechanical support and spacing system that is based on an architectural grade galvanized steel pan specifically designed for the application of thin brick veneers. The Key-Lok support panels are 16" inches high and 48" inches in length. The Key-Lok thin brick system is a 4 component system, comprising a mechanical support and spacing system (the galvanized steel sheet), the brick, the mortar, and an adhesive to secure the brick to the steel sheet.

See also, U.S. Pat. Nos. 421,742 (Feb. 18, 1890, Marsh); 520,137 (May, 1894, Deslauriers); 802,727 (Oct. 24, 1905, Altschuler); 874,909 (December, 1907, Fischer); 1,555,414 (September, 1925, Hale.); 1,946,690 (Feb. 13, 1934, Haines); 2,003,996 (June, 1935, Finzer et al.); 2,043,706 (June, 1936, Myers); 2,054,511 (September, 1936, Hornicek); 2,087,931 (Jul. 27, 1937, Wallace et al.); 2,101,612 (December, 1937, Duffy.); 2,132,547 (October, 1938, Sohn.); 2,200,649 (May, 1940, Wardle); 2,213,355 (September, 1940, Woodworth.); 2,300,258 (October, 1942, Kublanow.); 2,317,428 (April, 1943, Anderson.); 2,791,117 (May, 1957, Bailey.); 2,832,102 (Apr. 29, 1958, Amoruso); 2,919,572 (January, 1960, Salzi.); 2,924,963 (February, 1960, Taylor et al.); 2,938,376 (May, 1960, Workman et al.); 3,005,293 (Oct. 24, 1961, Hunter); 3,321,883 (May 30, 1967, Pascucci); 3,331,180 (July, 1967, Vissing et al.); 3,434,257 (March, 1969, Sakuma.); 3,520,095 (July, 1970, Jonason et al.); 3,533,206 (October, 1970, Passeno, Jr.); 3,908,326 (September, 1975, Francis.); 4,011,702 (March, 1977, Matyas); 4,238,915 (December, 1980, Yoshida et al.); 4,244,155 (January, 1981, Swiger.); 4,407,104 (October, 1983, Francis.); 4,407,107 (October, 1983, Smith, Jr.); 4,641,473 (February, 1987, Trezza.); 4,662,140 (May, 1987, Porter et al.); 4,736,552 (April, 1988, Ward et al.); 4,773,201 (September, 1988, Trezza.); 4,809,470 (March, 1989, Bauer et al.); 4,856,245 (August, 1989, Osawa.); 4,947,600 (Aug. 14, 1990, Porter); 4,956,949 (September, 1990, Francis.); 4,987,712 (January, 1991, Mancuso); 5,006,011 (April, 1991, Hiyashi), 5,051,049 (Mar. 26, 1996, Francis et al.); 5,228,937 (Jul. 20, 1993, Passeno); 5,311,714 (May 17, 1994, Passeno); 5,373,676 (Dec. 20, 1994 Francis et al.); 5,379,561 (Jan. 10, 1995, Saito); 5,390,457 (Feb. 21, 1995, Sjolander); 5,860,261 (Jan. 19, 1999, LeBlanc); 6,098,363 (Aug. 8, 2000, Yaguchi); US 2003/0121225 (Jul. 3, 2003, Hunsaker); US 2004/0050003 (Mar. 18, 2004, Passeno); each of which is expressly incorporated herein by reference.

The Key-Lok system provides "brick keys" that, when encapsulated into the mortar, perform the function of seven to eight brick ties per brick. These keys are present at the lower edge of the thin brick as a support, and within the mortar on the upper edge. "Adhesive keys" allow the brick to "form mechanical adhesion to the metal rather than 'stuck' to the metal". These are indentations or slots in the steel, behind the brick, which therefore provide an adhesion strength dependent on the tensile strength of the adhesive, and not the strength of the bond between the adhesive and the steel. Each brick unit or piece is supported by and spaced with a support key ledge that is designed into the steel pan. A mechanical lock for the mortar and adhesive is provided for adherence. When the mortar and adhesive keys into these locks, each brick is permanently locked to the metal panel.

The thin brick support system may be mounted on various substrates, such as Orientated Strand Board (OSB), Exterior Grade Plywood, Exterior Grade Gypsum Sheathing, Block, Brick, Concrete and other sound substrates. Sheathing substrates may require a secondary weather resistive barrier such as Tyvek™ environmental barrier. The Key-Lok metal support pan has horizontal stiffening channels which add rigidity, allow for mechanical attachment, and create a chamber behind the system for water drainage and airflow. The metal support pan is approximately 0.012 in thickness and is designed as an architectural acceptable and commercial grade product, galvanized to a G-90 rating.

In order to mount the steel support pan, for wood frame construction, corner panels are required, which are installed before the regular flat panels. A benchmark is determined, and all measurements aligned with the benchmark, to assure level course of brick. A gap of ⅛" to ¼" of provided for thermal expansion. The panel is installed flat and tight to the supporting substrate, using non-corrosive fasteners, such as self tapping galvanized screws for steel studs, #8 coated deck screws for wood studs, and Tapcons, powder actuated or air actuated gun fasteners for masonry. Each panel has a "starter ledge" that rests on the brick supports of the panel below. Vertical joints are typically staggered on adjacent columns. The fasteners are placed in the channels, at a rate of about one per square foot, with an 8" vertical spacing (stud spacing horizontally) preferred on stud walls.

In order to mount the thin brick, adhesive is applied horizontally on the upper portion of the metal brick tracks along the adhesive locks. A ¼" bead is applied, leaving 2 inch gaps every 12" to 18" for moisture drainage. In most cases, corner bricks are to be installed first. Measurements are made for layout and to assure fit and brick spacing. Brick joints can be adjusted ±⅛", allowing a ¾" adjustment along a 40 foot wall. The mortar lock keys support the bricks. To ensure adhesion, the brick is nestled into the adhesive, breaking any "skin" that may have developed. The Key-Lok Mortar is a premixed product that comes in a bag, and requires the addition of clean potable water only. A Grout bag (a.k.a. Pastry bag) with a #5 tip is used to install the mortar into the joint. The mortar joint is fully filled so the mortar will grab the mortar key locks incorporated into the pan. The grout is squeezed into the bed (horizontal) joints first, starting at the top of the wall, with continuous movement. The joints are over-filled. The head (vertical) joints are then filled. Care is exercised to avoid getting excess grout on the face of the brick, since this is cosmetically unattractive, and therefore requires removal. When the mortar joints have become firm, thumb print dry, they are then pointed up with a metal brick jointing tool. Excess mortar is raked out, and the edges around brick compacted and sealed. The mortar is then striked with a commercially available tool, to compress the mortar into the joint and remove excess.

Another thin brick mounting system is the EZ Wall® Panel System, from American Brick Company, Detroit Mich. The system includes the EZ Wall® galvanized panel, mastic glue, and mortar for the joint. Similar to the Key-Lok system, bricks are supported by tabs in the mortar space, and initially held to the panel with adhesive, although the panel itself is flat with perforations and tabs extending perpendicularly from the plane of the panel. The panel is formed of 29 gauge, zinc coated galvanized to G-90 Commercial Grade coating protection, in four foot square panel sizes. The Insulok® system, also from American Brick Company, is similar, providing continuous ledges for the thin brick. See, www.ambrico.com/products.htm.

U.S. Pat. Nos. 5,501,049 and 5,373,676 each discloses a thin brick mounting system in which individual brackets are provided for each brick, supporting the brick and the bottom, with a dovetail retainer of a relatively thick panel retaining the top edge.

U.S. Published Patent Application No. 2003/0213212 discloses a thin brick mounting system in which a dovetail retainer of a relatively thick panel retains both the top and bottom edge of the thin brick.

U.S. Published Patent Application 2003/0121225 and U.S. Pat. Nos. 5,311,714, 5,228,937, and 4,947,600 each provides a thin brick mounting system in which a ledge is formed for supporting the brick on a lower edge thereof.

U.S. Published Patent Application 2004/0050003 and U.S. Pat. Nos. 6,098,363 and 3,321,883 each disclose a thin brick mounting system in which a panel has a set of retaining tabs formed thereon, each retaining tab both supporting a thin brick above and locking a top edge of a grooved brick below.

U.S. Pat. Nos. 2,832,102 and 5,390,457 each discloses a support panel for a specially contoured brick or tile, providing an interlocking structure which reduces the amount of mortar employed.

U.S. Pat. No. 4,662,140 provides a masonry or brick support panel having a set of ledges for supporting the lower edge of the brick, with adhesive strips supported by tabs protruding from the sheet to retain the brick to the panel.

U.S. Pat. Nos. 6,164,029, 4,890,433, 4,856,246, 4,238,915, 2,082,241, and 2,022,363, and each provide a tile or slabstone mounting panel with protrusions extending from the rear of the panel into a deep recess or recesses in the rear of the tile. This recess is, for example one quarter, one half, or more, of the time thickness, and the angle of the support is, for example, about 45 degrees.

U.S. Pat. Nos. 5,379,561, 4,987,712, and 3,005,293 each discloses a bracket system for retaining a wall panel, at the top and bottom edges, through a groove formed in each.

SUMMARY OF THE INVENTION

The present invention provides an improved steel support sheet for supporting architectural thin brick. The process and procedure is generally similar to the system and process described above with respect to the Key-Lok system, except as noted. Of course, other process and procedures, or variants thereon, may be employed in using the support sheet according to the present invention.

In contrast to the prior art, the present invention is adapted to employ a brick which has a shallow channel or indentation with an acute angle top edge in the rear. This channel engages a diagonally upward protruding extension of the support sheet, thus providing a torque which retains the thin brick against the support sheet. Therefore, in contrast to the prior art, the use of adhesive is not critical for affixing the thin brick to the support prior to grouting, and no bottom support ledge is required. This channel is, for example, less than one quarter the thickness of the brick, and preferably about one eighth inch deep. This depth allows a shallow angle tab to support the brick, which then employs principally the compression strength of the panel material and not the resistance to bending, to support the brick. Thus, in contrast to deeply grooved tiles according to the prior art, the support may be a simple perforated and indented shape, and need not have a complex profile to engage a groove or recess. In addition, the mortar space tab acts as a mortar lock.

The panel may also have a tabs that hook into an adjoining dovetail.

Thus, the adhesive becomes less critical in the process, and therefore, if used, may serve a different function. For example, the adhesive may be selected for low cost or high availability, long cure time to allow repositioning of brick, or the like. On the other hand, the thin brick is held to the support by the force of a steel arm against a recess in the brick, for example a dovetail, rather than the tensile strength of an adhesive. Installation is simplified, since the thin brick may be temporarily held in place or repositioned (assuming any adhesive has not cured), and may be tested prior to committing to placement. A suitable adhesive is PL-200® Construction Adhesive.

A preferred source for the thin brick with recess is Endicott Clay Products Co., Fairbury, Nebr. The brick is produced, for example, through an extrusion process, with a die producing a brick having the desired cross section including the recess, which is, for example, a dovetail about 2 mm below the rear face of the brick. Advantageously, a symmetrical pair of dovetails is provided in the upper and lower half of the brick, allowing the arm of the support sheet to engage above the center of gravity of the thin brick, without concern for a "top" and "bottom" of a brick.

Typically, thin brick is extruded in blocks which result in more than one brick per cross section, for example, 4 bricks, and in a continuous or long section. Surface texture and/or coloration may be applied to the structure in this state. The cross section of this structure is shown in FIG. 6. The quad thin bricks are then vitrified in a kiln. The thin bricks are then separated by fracture, to produce a single thin brick as shown in FIG. 7.

The preferred brick for use with the support therefore has a dovetail groove on the backside of the brick. The support panel has an upwardly protruding tab or claw, which engages the groove, to support the brick. Because of this supporting structure, a supporting ledge is not required below the thin brick. However, advantageously, as set of tabs are provided which protrude into the joint space, which may advantageously be at an opposite angle to the support tab, i.e., downwardly facing. In this configuration, a tensile force withdrawing the brick from the support causes a compression of the cured mortar against the edge of the brick, impeding movement. Thus, in contrast to a simple horizontal ledge, i.e., at right angles to the plane of the support panel, the present invention provides a structure which tends to employ the strength of the mortar to hold the thin brick in place. The tabs thus form a mechanical lock.

It is therefore an object of the present invention to provide a thin brick panel mounting system in which the initial placement of the thin brick on the panel is not dependent on an adhesive. Therefore, the brick is supported by at least two points displaced along a vertical axis, such as the upper and lower edge, or lower edge and a rear groove. It is noted that the lower edge support in the later case need only be the flat surface of the panel, since the groove support induces a rearward torque at the lower corner of the brick.

It is another object of the present invention to provide a thin brick mounting panel which is efficient and simple in design, yet provides secure retention of thin brick against the panel during installation and thereafter.

According to another aspect of the invention, the placement of perforations may be in a simple regular array, for normal walls, or in a custom pattern, for edges, doorways, patterns and visual designs, and the like. Preferably, custom designs are formed using a numerically controlled punch, based on output from a design program programmed to produce a pattern which corresponds to a desired end result. Advantageously, the panel, either prior to or after punching, may be printed, for example using a lithograph, silk screen, ink jet technology, laser marking, or the like, with the custom pattern, to facilitate on-site assembly without error.

The present invention therefore also provides a computer assisted design (CAD) system for design and layout of wall patterns, providing a minimum of waste, precut and preformed supports, having thereon instructional elements to facilitate usage. Thus, each panel may be labeled with its intended location and neighboring panels, as well as the pattern of bricks (or other elements) to be supported thereon. Custom bricks, such as short brick, edges, curved elements, or other design features, may be clearly marked to help avoid mistake, and to assure that the panel or wall as designed is faithfully implemented. This, in turn, allows a designer to exercise creativity in the initial design, with knowledge that the design information will be conveyed to the installer. This technique also allows computer optimization of both layout and design.

For example, at the design stage, the mechanical and aesthetic requirements may be input into a design software running on a standard-type personal computer (e.g., MS Windows XP, Apple Macintosh, Linux, Unix, etc.). Aesthetic patterns may be entered as a photograph or scan, for example. The program can then ensure that the functional criteria for the installation will be fully met, that the installation will be reasonably efficient, that a full bill of materials is provided to ensure that these can be readily ordered and supplied, and that an estimate of labor and material cost is available, optionally allowing a designed to determine the sensitivity of the installation cost to changes in design parameters. Further, an aesthetic pattern may be imposed on the design, with panels clearly marked with the pattern and implementation. For example, brick of selected color, shape, and/or surface texture may be selected for different locations on the panel. Materials other than standard brick may also be incorporated into the design, and where necessary, the panel structure modified to properly layout and support these other materials. Especially where the mechanical properties of these other materials differ from thin brick, the software may determine the effect of these other materials on the overall installation and resulting structure, to ensure that the implementation is reasonably efficient and mechanically sound. For example, stone, stucco, glass, or other materials may be designed into the façade.

The design program may also interface with more general architectural design software, to account for windows, doors, corners, lighting, and other architectural features and requirements, without substantial duplication of efforts between the normal architectural design and the panel design. Likewise, as discussed above, the design program also interfaces with a computer assisted manufacture (CAM) system to produce the customized panels according to the design parameters.

It is therefore understood that the computerized design, custom forming of the support panels, and/or imprinting of the panels with layout and/or installation information may be implemented separately from the preferred thin brick support arrangement of the preferred embodiment of the invention.

The numerically controlled punch is preferably produces a semicircular tab, which has an angle of +18 degrees for the groove retaining tab and −83 degrees for the mortar space tab.

The technologies provided herein may be used in a consistent manner with known devices and methods. Thus, for example, a high solids adhesive mastic may be used, even if not strictly necessary. Likewise, the panel need not be planar, and may therefore include recesses. However, according to a preferred embodiment of the present invention, the groove retaining tab is the principal mounting element, and therefore a shelf is preferably not provided immediately below the brick, since this might reduce the retaining torque on the brick.

These and other objects will become apparent through a review of the drawings and detailed description of the preferred embodiments.

BRIEF DESCRIPTION OF THE DRAWINGS

FIGS. 7A, 7B, 7C and 7D show, respectively, front and side views of a 2¼ and 3⅝ high thin brick having a dovetail groove on the rear face thereof;

DETAILED DESCRIPTION OF THE PREFERRED EMBODIMENTS

As discussed above, various means are known for applying thin brick to a wall. Older methods employ a preform or apply the thin brick using adhesive to initially position the thin brick while the mortar sets. See FIGS. 1-4.

Figure 1:
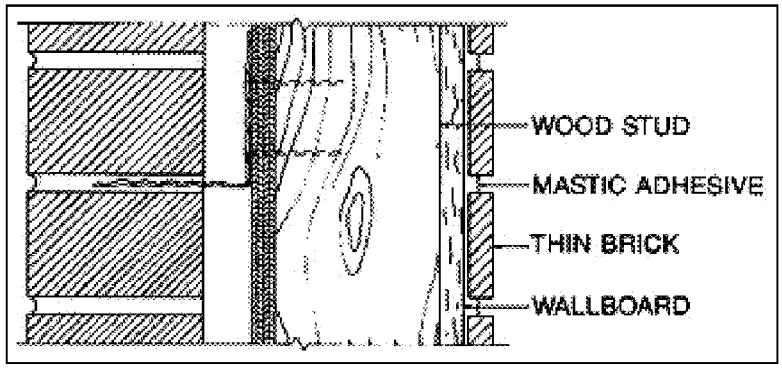
FIG. 1 shows installation of prior art thin set interior finish over wallboard
Figure 2:
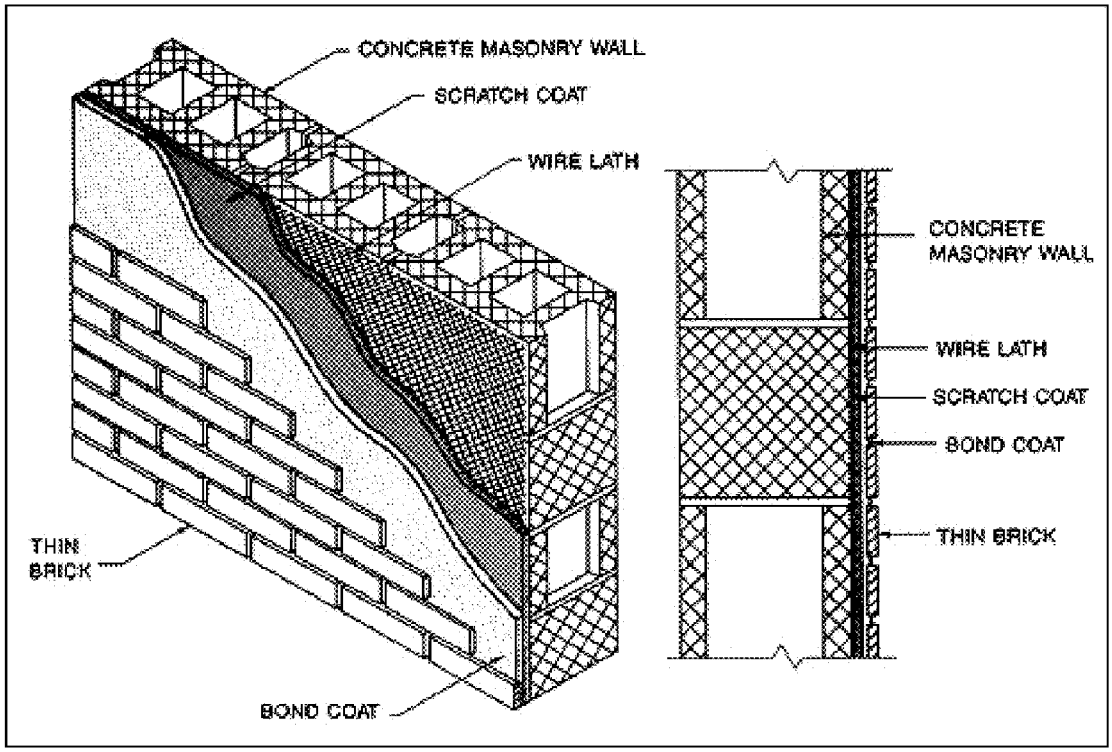
FIG. 2 shows installation of prior art thick set method over masonry
Figure 3:
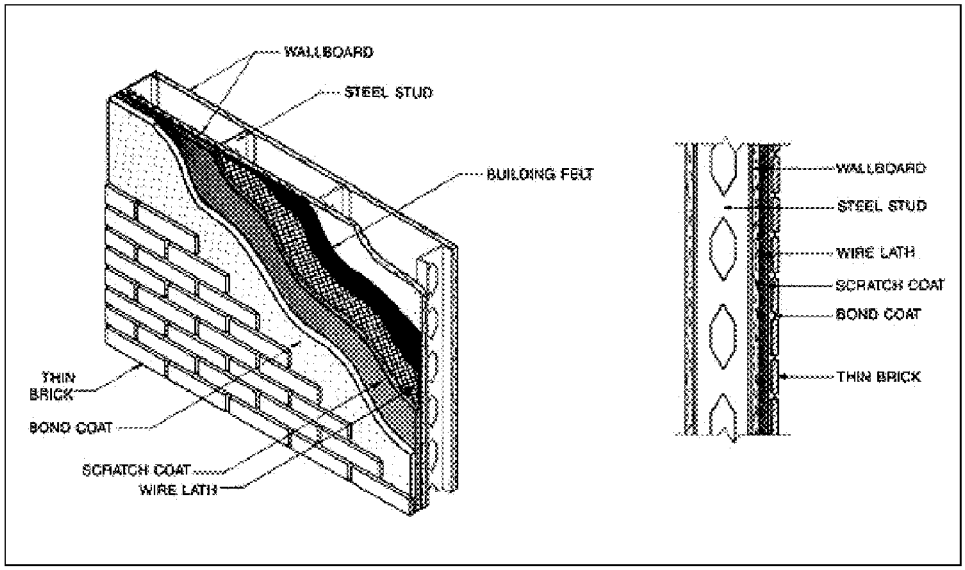
FIG. 3 shows installation of prior art thick set method over steel stud framing
Figure 4:
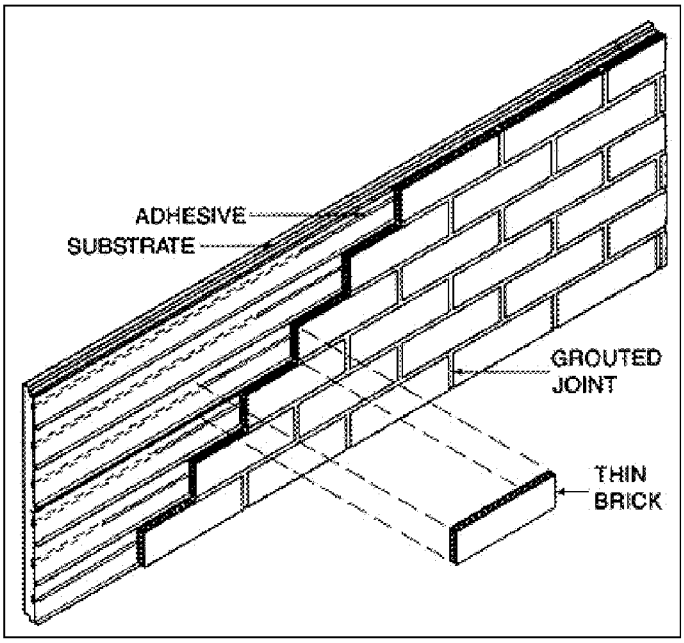
FIG. 4 shows installation of prior art thin brick panel
Figure 5:
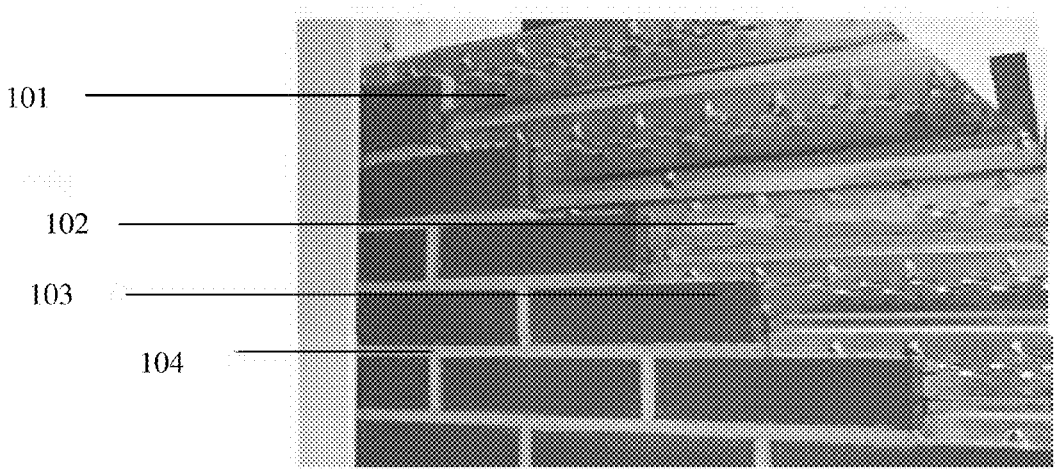
FIG. 5 shows installation of prior art steel support for thin brick

Newer methods employ a panel to support the thin brick, for example the Key-Lok system shown in FIG. 5, which provides a panel 101 having a brick shelf and adhesive recesses, on which an adhesive 102 is placed, and then the thin brick 103 and mortar are applied.

Figure 6A:
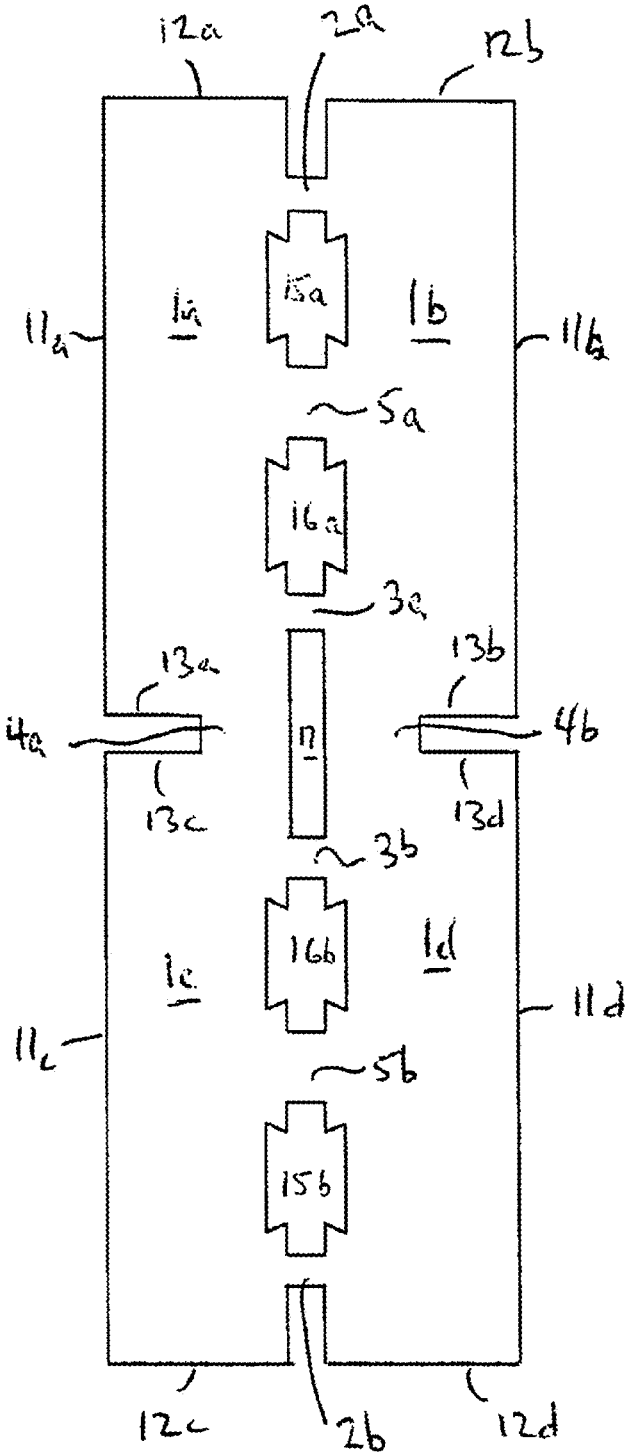
FIGS. 6A and 6B show cross sections, respectively, of an extruded quad-brick prior to separation and the resulting single brick.

A preferred embodiment of the present invention employs a thin brick, for example available from is Endicott Clay Products Co., Fairbury, Nebr., which advantageously has a groove formed in the rear. The thin brick is extruded in a generally continuous process, providing a cross section as shown in FIG. 6A. The quad bricks are then wire cut to length. In this configuration, an aesthetic treatment may be applied to the exterior surfaces only, of four bricks, which are then vitrified in a kiln. The extrusion die forms the four bricks, 1*a*, 1*b*, 1*c*, 1*d*, having faces 11*a*, 11*b*, 11*c*, 11*d*, outer edges 12*a*, 12*b*, 12*c*, 12*d*, inner edges 13*a*, 13*b*, 13*c*, 13*d*, as well as internal features, including outer keystone (dovetail) grooves 15*a*, 15*b*, inner keystone (dovetail) grooves 16*a*, 16*b*, and central space 17.

Figure 6B:
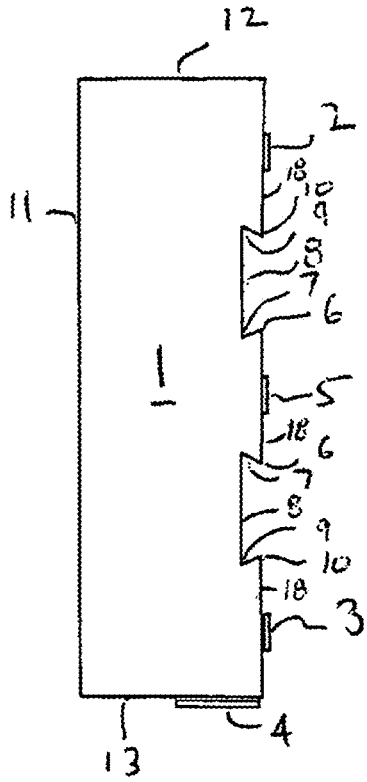

The terminal faces 14 (shown in FIG. 7A) of the brick are formed by a wire drawn through the clay or shale material. The brick is then fired in a kiln, until it is vitrified. The quad brick structure is then separated by fracture, after surface treatments are applied to the exterior surface, at bridges 2*a*, 2*b*, 3*a*, 3*b*, 4*a*, 4*b*, to produce four single bricks as shown in FIG. 6B.

The final thin brick 1 has an outer face 11, upper and lower edges 12, 13, the remains of bridges 2, 3, 4, and two dovetail grooves horizontally along the rear surface. These grooves each have a planar central portion 8, an acute angle wall 7, 9, defining a restricted opening as compared to the central portion 8, and an inner tip 6, 10 where the acute angle wall 7, 9 intersects the rear plane of the brick 18.

As shown in FIGS. 7A, 7B, 7C and 7D, the brick may be in a number of sizes, for example, 2¼" nominal and 3⅝" nominal, with thicknesses of ½", ⅝", or ¾". As shown, the typical angle for the dovetail groove walls is about 60 degrees, with a ⅛" depth for the central portion.

Figure 8:
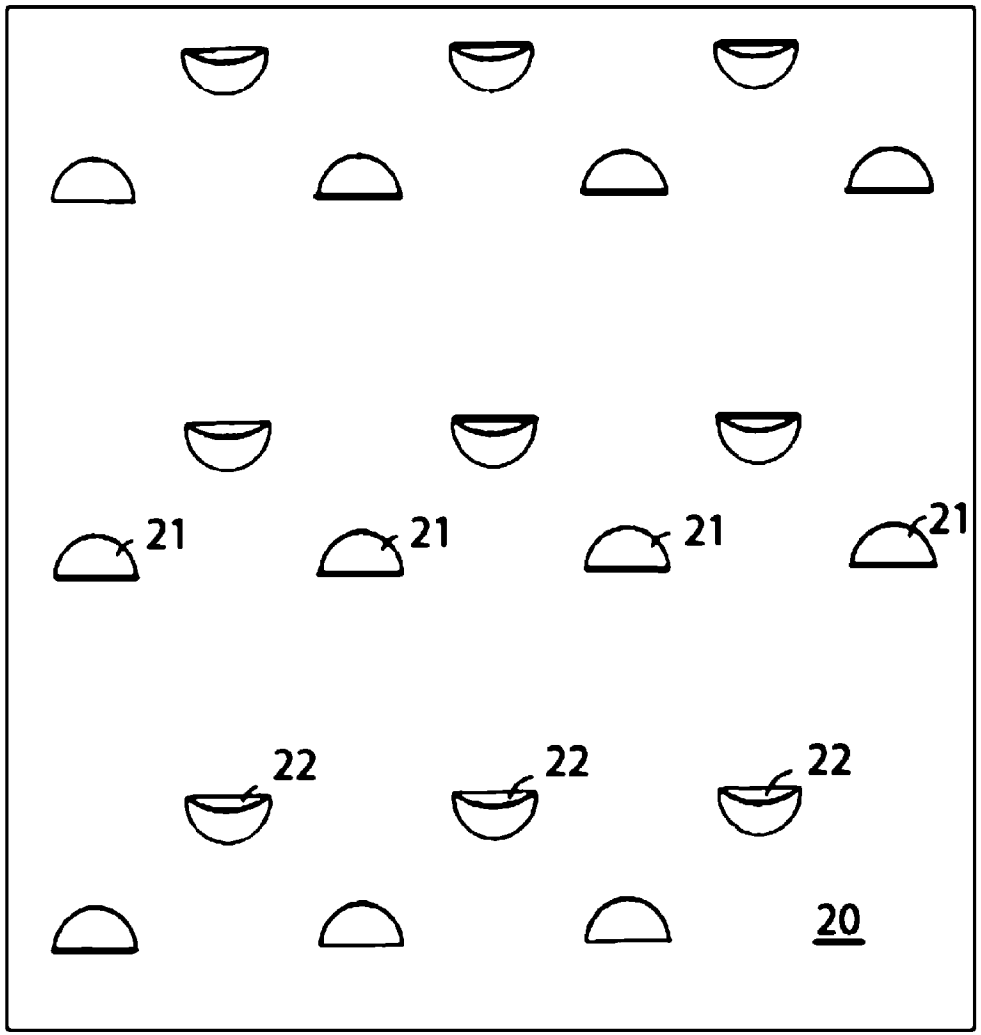
FIG. 8 shows a front view of a support panel in accordance with the present invention.

As shown in FIG. 8, a regular array of punched tabs is provided on a sheet 20, which is, for example, 22-30 gauge steel, zinc coated galvanized to G-60 to G-90 Commercial Grade coating protection, or aluminum. The sheet may be embossed or painted, as desired. Typical sheet sizes are 47 15/16" wide by 47¾" tall.

A set of groove retaining tabs 21, are provided, 5/16" radius, bent up about 18 degrees (bend radius 1/16")), with the opening on the top, spaced 2" horizontal and vertically spaced 2.656" for 2¼" nominal brick and 4.031" for 3⅝" nominal brick. A set of mortar space tabs 22 are provided, 5/16" radius, bent up about 83 degrees (bend radius 1/16")), with the opening on the bottom (97 degrees with respect to groove retaining tab 21 baseline), spaced 2" horizontal and vertically spaced 2.656" for 2¼" nominal brick and 4.031" for 3⅝" nominal brick. The groove retaining tabs 21 and mortar space tabs 22 are displaced 1" horizontally and 1.0667" vertically (between groove retaining tab 21 and mortar space tab 22 for a respective upper mortar space 23).

Figure 9A:
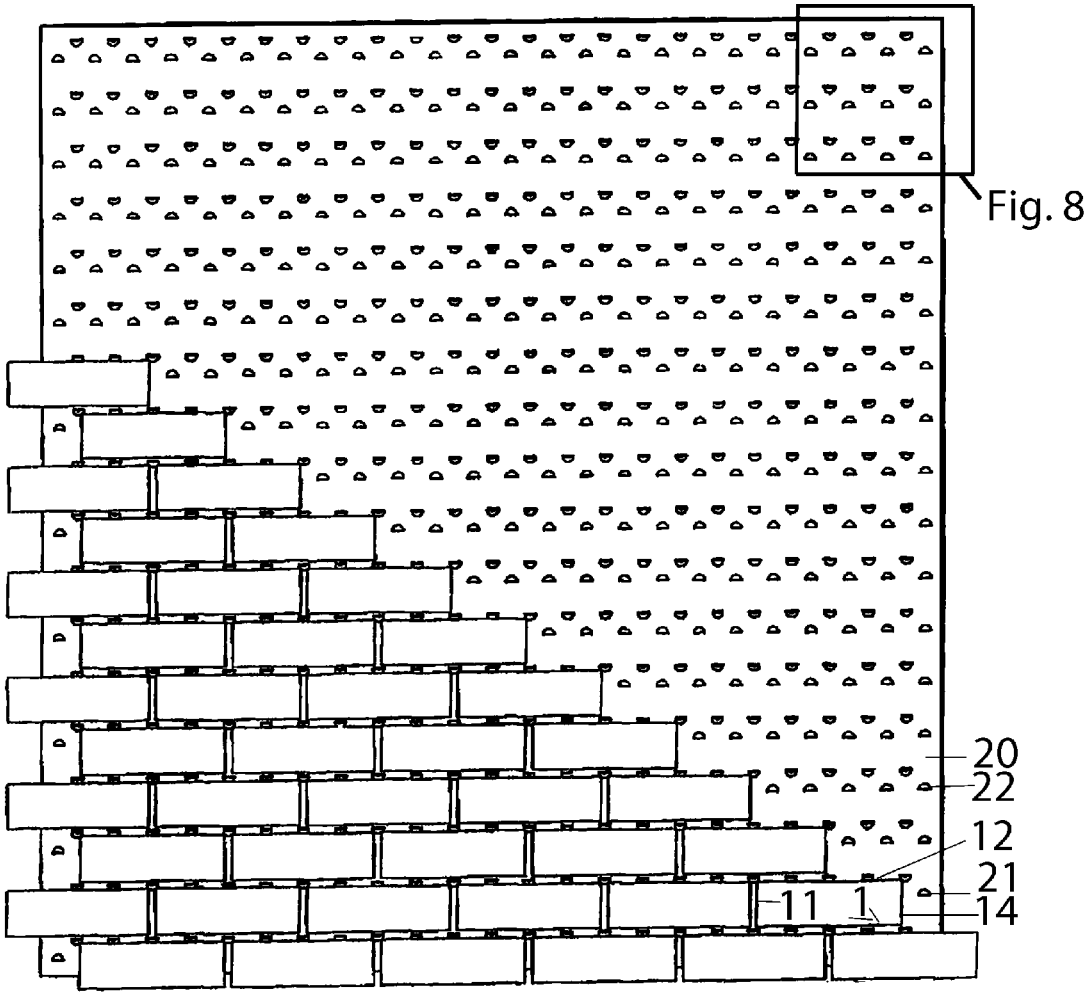
FIGS. 9A and 9B shows a front view of a partially constructed panel, and a side view, having thin brick installed on the panel of FIG. 8.
Figure 9B:
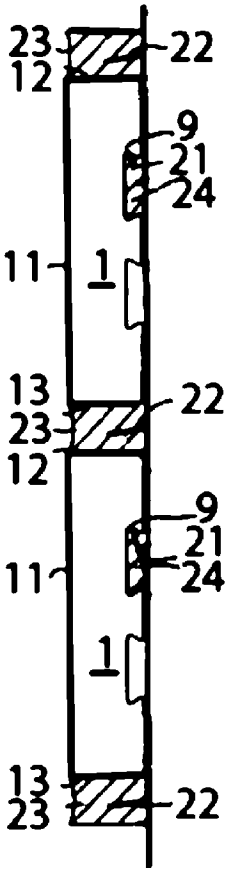

As shown in FIG. 9A, thin brick 1 is placed such that the groove retaining tabs 21 support the thin brick 1 at the acute angle wall 9 of the dovetail groove. As shown in FIG. 9B, Preferably, during the mortar process, mortar is forced into at least the upper dovetail groove 24, as well as the space between courses of brick 23. After the mortar is hardened, any tensile force on the brick 1 seeking to draw it away from the panel 20, will cause a compressive force between the groove retaining tabs 21, acting on the acute angle wall 9, and the mortar space tab 22, acting through the hardened mortar 23 on the upper edge of the brick 12. To unseat the brick, either the mortar 23, 24 must disintegrate, or the metal tabs 21, 22 must fail.

In order to facilitate filling the space near the groove retaining tab with mortar, the tab extends deeper than the recess in the thin brick, forming a gap behind the upper side of the brick, and thereby maintaining a pathway for the mortar to enter the space 24.

Therefore, it can be seen that the present design provides a mechanical retention of the brick to the support panel, independent of an adhesive, and thus is advantageous. An adhesive may be used if desired, but this adhesive is not critical, and therefore may be selected to facilitate installation, rather than for its long-term properties.

While the above detailed description has shown, described and pointed out the fundamental novel features of the invention as applied to various embodiments, it will be understood that various omissions and substitutions and changes in the form and details of the system and method illustrated may be made by those skilled in the art, without departing from the spirit of the invention. Consequently, the full scope of the invention should be ascertained by the appended claims.

What is claimed is:

1. A method for mounting thin brick having a shallow dovetail groove formed on a rear surface thereof comprising the steps of:

(a) mounting a panel to a vertical surface, said panel comprising a metal sheet having front and rear surfaces, having a first array of punched groove retaining tabs having first tab edges protruding from said front surface at an upward angle of less than about 45 degrees; and a second array of punched mortar lock tabs having second tab edges, said second tab edges protruding from said front surface at a downward angle of greater than about 45 degrees, said first array of mortar lock tabs being formed along a horizontal axis at a different height than a horizontal axis along which said second array of groove retaining tabs are formed, said first tab edges being configured to seat at an intersection of a recessed vertical wall and an inclined surface of the shallow dovetail grooves to thereby support the thin brick;

(b) placing a plurality of thin bricks on said array of groove retaining tabs with gaps between vertically adjacent courses of thin brick, such that the first tab edges are seated within the shallow dovetail grooves formed in the rear of the thin bricks and the mortar lock tabs are disposed in gaps between vertically adjacent rows of thin bricks, the mortar lock tabs being configured to not interfere with a seating of the thin bricks on the first tab edges; and (c) filling the gaps between the thin bricks with a mortar to thereby encase the mortar lock tabs, wherein in response to a tensile force away from said front surface, the mortar lock tabs exert a downward force component, to thereby counter an upward force component exerted by the first tab edges acting on the inclined surface of the shallow dovetail grooves.

2. The method according to claim 1, wherein the panel comprises a set of markings defining a thin brick placement pattern, further comprising the step of placing the plurality of thin bricks on said array of groove retaining tabs in accordance with the thin brick placement pattern.

3. The method according to claim 1, wherein the panel comprises galvanized steel, said groove retaining tabs and mortar lock tabs comprise deflected central portions of punched semicircular perforations having a radius of about 5/16 inch, said groove retaining tabs extending upward and outward at an angle of about 18 degrees and said mortar lock tabs extending downward and outward at an angle of about 83 degrees.

4. The method according to claim 1, wherein said first tab edges, and second tab edges protrude from said metal sheet from a same side thereof.

5. The method according to claim 1, wherein the dovetail grooves on the back of the thin bricks are seated on the first tab edges substantially without requiring an adhesive between the thin brick and said panel.

6. The method according to claim 1, wherein a pattern of said first array of groove retaining tabs and said second array of mortar lock tabs on said panel is produced with a programmable numerically controlled punch.

7. The method according to claim 6, wherein a thin brick placement pattern is ink jet printed on said panel corresponding to the programmable numerically controlled punch pattern of said first array of groove retaining tabs and said second array of mortar lock tabs.

8. The method according to claim 7, further comprising the step of receiving a computer generated file defining the thin brick placement pattern.

9. A method of supporting a thin brick layer on at least a portion of one side of a metal sheet, comprising:

(a) creating in the metal sheet an array of punched groove retaining tabs having first tab edges configured such that said first tab edges protrude from said sheet at an upward angle of less than about 45 degrees, for a distance of less than about one quarter inch, and an array of punched mortar lock tabs having second tab edges, such that the second tab edges protrude from the metal sheet at a downward angle of greater than about 45 degrees, the array of mortar lock tabs being offset vertically from the array of groove retaining tabs;

(b) engaging the first tab edges of a plurality of groove retaining tabs in a shallow dovetail groove formed in a rear surface of a thin brick, such that the thin brick is supported by gravity on the first tab edges, wherein a tensile force displacing the thin brick away from the metal sheet exerts an upward force on the thin brick through an inclined surface of the dovetail groove; and (c) curing a mortar in a space between the thin bricks, comprising at least a space into which said array of mortar lock tabs protrude, wherein a tensile force displacing the thin brick away from the metal sheet exerts a downward force on an adjacent thin brick through a brick edge, to thereby exert a force in an opposite direction to a force applied to the thin brick along a vertical axis by said groove retaining tabs resulting from the tensile force, to thereby retain the thin brick against the panel.

10. The method according to claim 9, wherein the metal sheet comprises galvanized steel.

11. The method according to claim 9, wherein the metal sheet comprises aluminum.

12. The method according to claim 9, wherein the groove retaining tabs are formed by forwardly deflecting central portions of punched semicircular perforations in the metal sheet, and the mortar lock tabs are formed by forwardly deflecting central portions of punched semicircular perforations in said sheet.

13. The method according to claim 9, wherein said groove retaining tabs extend upward and forward at an angle of about 18 degrees, and said mortar lock tabs extend downward and forward at an angle of about 83 degrees.

14. The method according to claim 9, wherein said metal sheet comprises galvanized steel, said groove retaining tabs and mortar lock tabs comprise deflected central portions of punched semicircular perforations having a radius of about 5/16 inch, said groove retaining tabs extending upward and forward at an angle of about 18 degrees and said mortar lock tabs extending downward and forward at an angle of about 83 degrees.

15. The method according to claim 9, wherein a pattern of said groove retaining tabs and said mortar lock tabs on said panel is produced with a programmable numerically controlled punch, further comprising marking the metal sheet with a thin brick placement corresponding to the programmable numerically controlled punch pattern of said first array of groove retaining tabs and said second array of mortar lock tabs.

16. The method according to claim 9, further comprising the step of receiving a computer generated file defining the thin brick placement pattern.

17. A method of supporting thin brick on a metal sheet, comprising;

(a) punching, in the metal sheet, an array of groove retaining tabs having first tab edges, configured such that the first tab edges protrude from the front surface of the sheet at an upward angle of less than about 45 degrees, for a distance of less than about one quarter inch; and (b) punching, in the metal sheet, an array of mortar lock tabs having second tab edges, configured such that the second tab edges protrude from the front surface of the sheet at a downward angle of greater than about 45 degrees, the array of mortar lock tabs being offset vertically from the array of groove retaining tabs;

(c) inserting the first tab edges to into an upper edge of a dovetail groove formed in the rear of thin bricks, wherein the second tab edges are disposed to protrude into a space between horizontal courses of thin bricks, and wherein a space is maintained between vertically adjacent thin bricks;

(d) placing a mortar in the space surrounding the thin bricks, wherein in response to a tensile force on a brick along an axis away from said front surface, a force having an upward component is exerted on the dovetail groove and a force having a downward component is exerted on a brick upper side, to thereby tend to retain the thin brick against the front surface of the sheet.

18. The method according to claim 17, wherein the array of groove retaining tabs and the array of mortar lock tabs are formed by deflecting portions of the metal sheet forward and upward at an angle of about 18 degrees from semicircular perforations in the metal sheet, and the groove retaining tabs are deflected forward and downward at an angle of about 83 degrees from semicircular perforations in the metal sheet.

19. The method according to claim 17, wherein the thin bricks have a thickness of less than about one inch, having formed on a rear surface thereof a shallow dovetail groove having a depth less than about one quarter the thickness of the brick.

20. The method according to claim 17, wherein a pattern of said groove retaining tabs and said mortar lock tabs on said panel is produced with a programmable numerically controlled punch, further comprising marking the metal sheet with a thin brick placement corresponding to the programmable numerically controlled punch pattern of said first array of groove retaining tabs and said second array of mortar lock tabs.

21. The method according to claim 17, further comprising the step of receiving a computer generated file defining the thin brick placement pattern.

* * * * *